United States Patent [19]

Brummett et al.

[11] 4,054,412

[45] Oct. 18, 1977

[54] CLOTHES WASHING MACHINE AND METHOD OF WASHING CLOTHES

[75] Inventors: John F. Brummett; Joseph L. Todd, both of Louisville, Ky.

[73] Assignee: General Electric Company, Louisville, Ky.

[21] Appl. No.: 748,907

[22] Filed: Dec. 9, 1976

[51] Int. Cl.[2] ..... D06F 23/04; D06F 37/24

[52] U.S. Cl. ..... 8/158; 68/23.3

[58] Field of Search ..... 8/158, 159; 68/23.3, 68/23.4; 210/78, 144; 74/573 R; 68/23 R, 148

[56] References Cited

U.S. PATENT DOCUMENTS

| | | | |
|---|---|---|---|
| 1,847,159 | 3/1932 | Adams | 8/159 X |
| 2,278,911 | 4/1942 | Breckenridge | 68/23.5 |
| 2,700,473 | 1/1955 | Emmert et al. | 210/78 |
| 2,718,772 | 9/1955 | Sharp et al. | 68/23.4 |
| 2,976,998 | 3/1961 | Smith | 68/23.3 X |
| 3,306,082 | 2/1967 | Hasegawa et al. | 68/23.3 X |

*Primary Examiner*—Philip R. Coe

*Attorney, Agent, or Firm*—Frederick P. Weidner; Francis H. Boos

[57] ABSTRACT

An improved clothes washing machine and method of washing clothes for increasing the unbalance capacity of the machine. The machine includes a tub for containing water, a clothes receiving basket in the tub, the basket having perforations arranged in a pattern from the top to the bottom of the side wall of the basket, a pump for removing water from the tub, and a mechanism for rotatively accelerating the basket from zero to over 220 revolutions per minute. The unbalance capacity improvement is achieved by retaining between 20 and 40% of the initial water in the machine as measured under water only load conditions until 220 revolutions per minute is reached, pumping water continuously from between the tub and basket during such basket acceleration and discharging it from the machine, and restricting the flow of water from the basket to the tub such that the level of water between the tub and basket is lower than the level of water in the basket during such acceleration.

7 Claims, 7 Drawing Figures

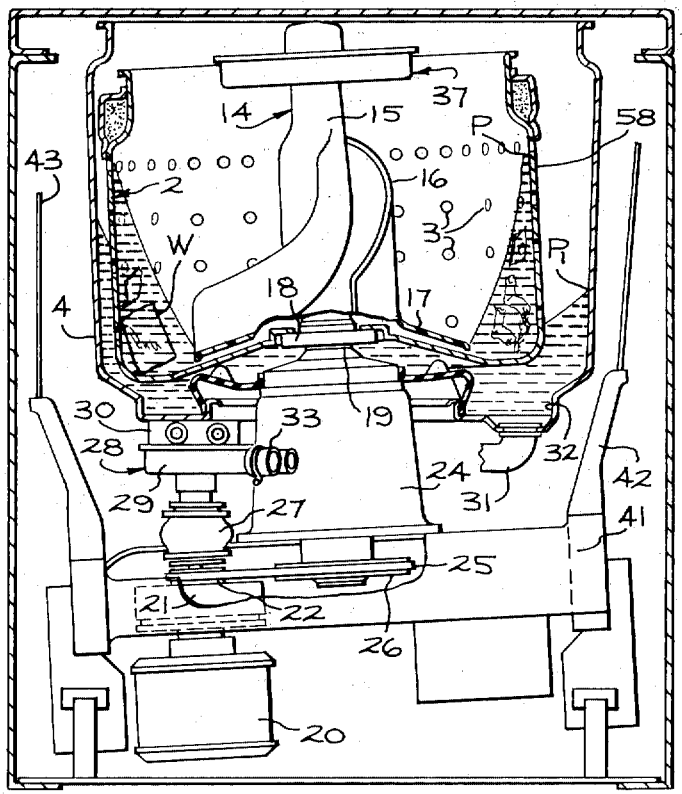
FIG. 3
FIG. 2
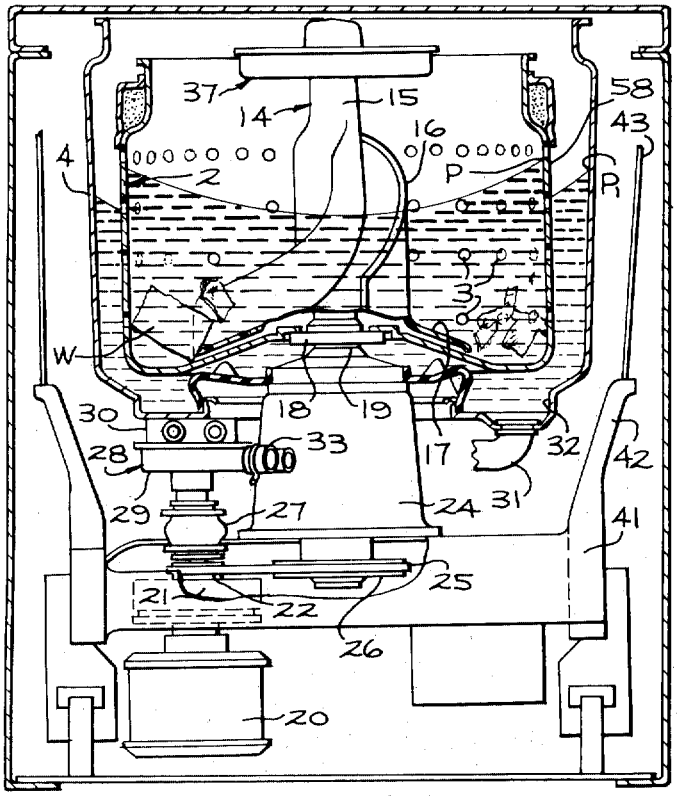

CLOTHES WASHING MACHINE AND METHOD OF WASHING CLOTHES

BACKGROUND OF THE INVENTION

1. Field of the Invention

This invention relates to automatic clothes washing machines and the method of washing clothes and more particularly to an improved structure for increasing the unbalance capacity and the method of improving the inbalance capacity in a clothes washing machine.

2. Description of the Prior Art

Automatic clothes washing machines customarily provide a sequence of operations in order to wash, rinse, and extract water from the clothes contained in a basket. The sequence ordinarily includes a washing operation which, in a vertical axis type machine, is provided by an agitator movably arranged to oscillate back and forth within the basket; a first centrifugal liquid extraction operation in which the wash water is removed from the clothes by spinning the basket; a rinsing operation in which the clothes in the basket are rinsed in clean water while the agitator is oscillated; and a final centrifugal liquid extraction operation in which the basket is spun to remove the rinse water from the clothes. Machines having this type of cycle, or a variation thereof, generally produce highly satisfactory results in that the clothes in the machine come out properly cleaned and with a substantial part of the liquid removed.

A typical type clothes washing machine as shown and described in U.S. Pat. No. 3,570,274 assigned to the same assignee as the present invention. Such clothes washing machines have a stationary outer water containing tub and an inner perforated basket, the latter of which, during the centrifugal liquid extraction operations, is spun at high speed so that liquid is forced from the clothes within the basket through the perforations in the basket and into the outer tub. From the outer tub the liquid is removed from the machine to a drain by a conventional pumping means.

One disadvantage that can occur in such a clothes washing machine during the centrifugal liquid extraction operations is that should the articles being washed bunch up or have unequal weight distribution about the axis of rotation the basket may become unbalanced. If the unbalance is sufficient during acceleration of the spinning basket the basket may strike the outer tub which can result in injury to the machine and in some cases the striking may be so violent that the basket is prevented from reaching its intended rotational speed. The unbalance capacity of a given clothes washer machine is most noticeable when the clothes basket is being accelerated through its critical or resonance of vibration speed where it is likely to strike the tub due to an unbalance within the basket. It has been known that if the mass of the basket is increased such as for example by retaining a relatively high volume of water within the basket during its acceleration through the critical speed that the unbalance capacity will be improved. Accordingly unbalance problems most likely occur with small wash loads rather than large loads. For instance, such prior art disclosures are found in U.S. Pat. Nos. 3,306,082 and 2,976,998. The problem with these prior art clothes washing machines, however, is that while a greater volume of water may aid in improving the unbalance capacity of a machine, it detrimentally affects the power consumption necessary to accelerate the basket. In many cases the motor is insufficient to handle the load without increasing its size. In addition, the capability of extracting liquid from the clothes during the spinning is sacrificed.

By this invention we have improved the unbalance capacity of washing machines with no significant increase in power consumption and without significant decrease in liquid extraction from the clothes.

SUMMARY OF THE INVENTION

There is provided in a vertical axis clothes washing machine having a centrifugal water extraction operation a tub for containing water, a pump for removing water from the tub, and a clothes receiving basket having perforations arranged in a pattern along the side wall and located within the tub. There is also provided within the machine means for rotatively accelerating the basket from 0 to over 220 revolutions per minute, and means to retain between 20 and 40% of the initial water in the machine as measured under water only load conditions until the basket reaches 220 revolutions per minute. There is means to pump water continuously from between the tub and basket during said basket acceleration from zero to over 220 revolutions per minute and discharge it from the machine and means to restrict the flow of water from the basket to the tub such that the level of water between the tub and basket is lower than the level of water in the basket during such basket acceleration.

BRIEF DESCRIPTION OF THE DRAWINGS

FIG. 2 is a schematic front elevational view of a clothes washing machine incorporating my invention and similar to FIG. 1 showing the machine near the beginning of its acceleration and prior to the critical speed;

FIG. 3 is a schematic front elevational view of a clothes washing machine incorporating my invention and similar to FIG. 1 showing the machine during acceleration through the critical speed;

DESCRIPTION OF THE PREFERRED EMBODIMENT

Figure 1:
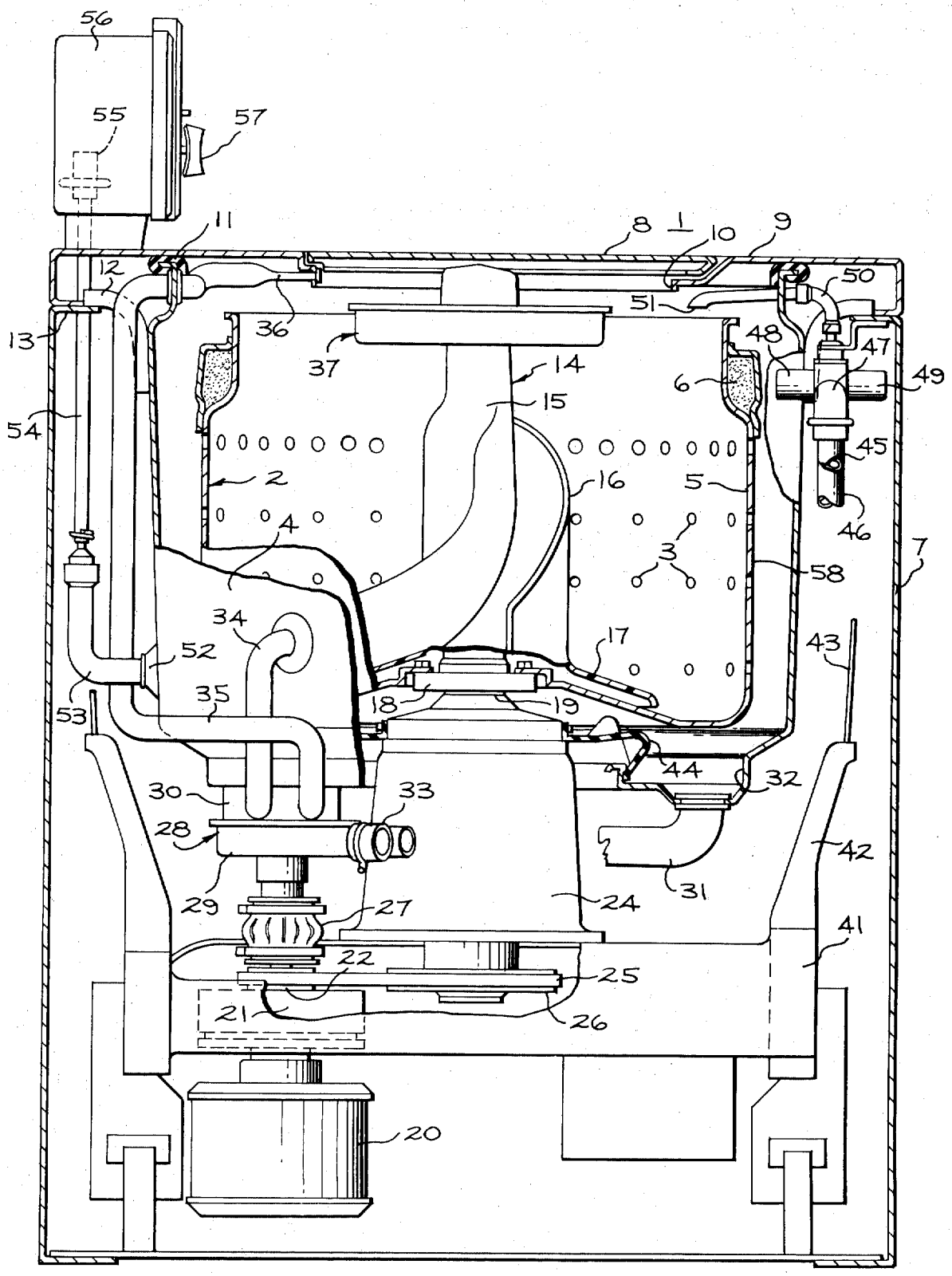
FIG. 1 is a schematic front elevational view of a clothes washing machine incorporating my invention, the view being partially broken away and partially in section.

Referring now to FIG. 1, there is shown therein an agitator-type clothes washing machine 1 having a conventional basket or clothes receiving receptable 2 provided along its side wall with perforations 3 and disposed within an outer imperforate tub 4 which serves as a liquid receptable. The basket 2 may be provided at the top thereof with a balance ring 6 to help steady the basket when it is rotated at high speed.

Tub 4 is rigidly mounted within an appearance cabinet 7 which includes a cover 8 hingedly mounted in the top portion 9 of the cabinet for providing access to an opening 10 into the basket 2. As shown, a gasket 11 may be provided so as to form a seal between the top of the tub 4 and the portion 9 of the cabinet thereby to prevent escape of moisture and moist air into the cabinet around the tub. The rigid mounting of tub 4 within the cabinet 7 may be effected by any suitable means. As a typical example of one such means I have provided strap members 12, each of which is secured at one end to an inturned flange 13 of the cabinet and at its other end to the outside of tub 4.

At the center of basket 2 there is positioned a vertical axis agitator 14 which includes a centerpost 15 and a plurality of curved water circulating means 16 joined at their lower ends by an outwardly flared skirt 17. Both the clothes basket 2 and the agitator 14 are rotatably mounted. The basket is mounted on a flange 18 of a rotatable hub 19 and the agitator 14 is mounted on a shaft (not shown) which extends upwardly through the hub 19 and through the centerpost 15, and is secured to the agitator so as to drive it.

During a sequence of operations of the machine 1, water is introduced into tub 4 and basket 2. Agitator 14 is then oscillated back and forth about its axis to wash the clothes therein. Then, after this washing step or period is completed, basket 2 and agitator 14 are rotated in unison at high speed to extract centrifugally washing liquid from the clothes and discharge it to drain. Following this extraction operation a supply of clean liquid is introduced into the basket for rinsing the clothes and the agitator is again oscillated. Finally, the basket and agitator are once more rotated at high speed to extract the rinse water. Basket 2 and agitator 14 may be driven through any suitable means. By way of example, I have shown them as driven from a reversible motor 20 through a system including a clutch 21 mounted from the motor shaft. Motor 20 is a single speed motor, and, in order to provide two different speeds of operation for agitator 14, the clutch mechanism 21 is of the two-speed type. Depending upon the selection by the operator, clutch 21 is effective to drive its output pulley 22 either at the speed of motor 20 or at a predetermined lower speed.

The output pulley 22 transmits power to a transmission assembly 24 through a belt 25 and pulley 26. Thus, depending upon the direction of motor rotation, pulley 26 and transmission 24 are driven in opposite directions. Transmission 24 is so arranged that it supports and drives both the agitator drive shaft and the basket mounting hub 19. When motor 20 is rotated in one direction the transmission causes agitator 14 to oscillate in a substantially horizontal plane within the basket 2 at the speed determined by clutch 21. Conversely, when the motor 20 is driven in the opposite direction the transmission rotates wash basket 2 and agitator 14 together at a centrifuging speed determined by clutch 21 for centrifugal liquid extraction.

In addition to operating transmission 24 as described, motor 20 also provides a direct drive through a flexible coupling 27 to a pump structure, generally indicated at 28, which may include two separate pump units 29 and 30, both operated simultaneously in the same direction by motor 20. Pump unit 29 has an inlet which is connected by a conduit 31 to an opening 32 formed at the lowermost point of tub 4. Pump unit 29 also has an outlet which is connected by conduit 33 to a suitable drain (not shown). Pump unit 30 has an inlet connected by a conduit 34 to the interior of tub 4 and outlet connected by a conduit 35 to a nozzle 36. The pumps are formed so that in the spin direction of motor rotation pump 29 will draw in liquid from opening 32 through conduit 31 and discharge it through conduit 33 to drain, and in the other direction of rotation pump 30 will draw in liquid through conduit 34 and discharge it through conduit 35 and nozzle 36, each of the pumps being substantially inoperative in the direction of rotation in which it is not used.

Nozzle 36 is positioned to discharge into a filter pan 37 secured on the top portion of agitator 14 so as to be movable therewith. With this structure then, when the motor is rotating so as to provide agitation, pump 30 draws liquid through conduit 34 from tub 4 and discharges it through conduit 35 so that the liquid passes from nozzle 36 into filter pan 37 and then down through a number of small openings (not shown) provided in the bottom of filter pan and back into basket 2. In this manner, the filter pan 37 causes lint which is separated from the clothes during a washing operation to be filtered out of the water and thus prevented from being redeposited on the clothes.

Motor 20, clutch 21, transmission 24, basket 2 and agitator 14 form a suspended washing and centrifuging system which is supported by the stationary structure of the machine so as to permit isolation of vibrations from the stationary structure. It will be understood that such vibrations occur primarily as a result of high speed spinning of basket 2 with a load of clothes therein. While any suitable suspension structure may be used, one suitable structure includes a bracket member 41 with transmission 24 mounted on top thereof and motor 20 mounted to the underside thereof. The bracket member in turn is secured to upwardly extending rigid members 42 and each of the two upwardly extending members 42 is connected to a cable 43 supported from the top of the machine. While only a portion of the suspension system is shown in the drawings, such a vibration isolating system is fully described and claimed in U.S. Pat. No. 2,987,190 issued on June 6, 1961 to John Bochan and assigned to General Electric Company, assignee of the present invention.

In order to accommodate the movement which occurs between basket 2 and tub 4 without any danger of leakage between them the stationary tub 4 is joined to the upper part of transmission 24 by a flexible member 44. Member 44 may be of any suitable configuration, many of which are known in the art, to permit relative motion of the parts to which it is joined without leakage therebetween.

Hot and cold water may be supplied to the machine through conduits 45 and 46 which are adapted to be connected respectively to sources of hot and cold water (not shown). Conduits 45 and 46 are connected to a conventional mixing valve structure 47 having solenoids 48 and 49 so that energization of solenoid 48 permits passage of hot water through a valve to a hose 50, energization of solenoid 49 permits the passage of cold water through the valve, and energization of both solenoids permits a mixing of hot and cold water in the valve and passage of warm water into hose 50. Hose 50 has an outlet 51 positioned to discharge into basket 2 so that when one or both of the solenoids 48 and 49 are energized, water passes into basket 2 and tub 4.

The level to which water rises in the basket and tub may be controlled by any suitable liquid level sensing means. One typical arrangement for doing this is to provide an opening 52 in the side of tub 4 adjacent the bottom thereof, opening 52 being connected through a conduit 53 and a tube 54 to a conventional pressure sensitive switch device shown schematically as numeral 55 which may be positioned within the control panel 56 of machine 1. In the conventional manner, water rises in basket 2 and tub 4 and exerts increasing pressure on the column of air trapped in the tube 54, and at a predetermined pressure level the column of air then trips switch 55 to shut off whichever of solenoids 48 and 49 may be energized. The control panel 56 may have suitable manual controls, such as that shown at 57, extending therefrom so that the particular fabric cycle desired may be controlled to effect the washing of different types of fabrics.

The spin operation is provided at a relatively high speed of rotation of the basket that may, for instance, be on the order of 600 revolutions per minute, which is the case in the preferred embodiment, so as to extract a very substantial part of the liquid from the clothes and have it removed from the machine 1 by the pump 28. A spin operation is conducted after the washing operation and the rinsing operation. In both cases the machine is filled to the set water level and the agitator is oscillated back and forth. The water level during the washing and rinsing operations in the basket 2 is essentially level with the water level between the basket 2 and the tub 4. That is, during the washing and rinsing operations the water level equalizes between the basket and the tub by water communicating between the two through the perforations 3 in the basket 2. Just prior to when the spin operation is started the basket including the water and clothes contained therein are static. When the spin operation is initiated there is considerable torque required on behalf of the motor and the connecting mechanisms between the motor and the basket to spin the combined mass of basket, clothes and water. The rotational speed of the basket 2 will be accelerated gradually and will reach its critical rotational speed which in the machine described in the preferred embodiment can be in the range of 130 to 220 revolutions per minute. Critical speed is that speed whereupon the natural frequency or resonance of vibration of the system occurs. When the basket 2 and its contents are being accelerated through the critical rotational speed it is highly desirable to prevent any unbalance condition from causing the basket 2 to strike the tub 4. To prevent such unbalance it has been found that three factors are involved which should be controlled to prevent the unbalance from acting on the basket causing it to strike the tub. One factor is to have a sufficient amount of water retained in the basket so that the unbalance load may be immersed, or at least substantially immersed, in the water so that in effect there is on the opposite side of the basket a substantially equal mass of water thereby offsetting the unbalance weight. Another factor in improving the unbalance capacity of a given clothes washing machine is to have the basket and the load contained therein accelerated through the critical rotational speed as rapidly as possible thus preventing the chance of the unbalance condition becoming progressively worse or caused to resonate ultimately resulting in the basket 2 striking the tub 4. Once the basket and its contents reach post critical speed, that is above 220 revolutions per minute, the unbalance condition relatively unaffects the acceleration of the basket up to its maximum rotational speed which is indicated previously may be approximately 600 revolutions per minute. The third factor in improving the unbalance capacity is to have the spinning mass as great as possible when passing through its critical rotational speed.

While improving the unbalance capacity of a clothes washing machine is one consideration there is also the consideration in designing such a machine the highly desirable aspect of extracting as much liquid as possible from the clothes during the spin operation without prolonging the cycle. For this purpose it has been conventional to provide perforations in the cylindrical side wall of the basket which perforations usually have a pattern of multiple circular rows which extend from near the top of the basket to near the bottom of the basket. The purpose of these holes or perforations and their pattern arrangement is to provide passageways through the basket so that water being extracted centrifugally from the clothes may very readily pass into the tub whereupon it is removed by the pump mechanism as described above.

In prior art clothes washing machines when the basket was accelerating from zero to 220 revolutions per minute, a substantial amount of water would pass from the basket through the holes into the tub resulting in the level of the water in the basket being substantially the same height as the water in the area between the basket and the tub. The amount of water flowing from the basket through the holes would essentially keep up with the amount of water being removed from the tub. As a result, should there be an unbalance weight within the basket, the amount of water in the basket at the time the basket is being accelerated at the critical rotational speed would be reduced so that the unbalance weight would no longer be immersed thus there would not be sufficient water to counterbalance the unbalance weight. Moreover, since there is a relatively high level of water between the basket and the tub there is substantial frictional drag on the exterior surface of the basket thus inhibiting the basket from accelerating rapidly through the critical rotational speed.

By our invention we provide a basket 2 having perforations 3 arranged in a pattern or circular rows along the side wall 5 of the basket which extend from the upper portion of the basket to the bottom portion of the basket. The arrangement of the perforations 3 and their diameter are constructed and arranged so that while the basket 2 is accelerating from zero to 220 revolutions per minute the flow of water from the basket to the tub is restricted. In addition, there are means to pump water continuously from between the tub and the basket during basket acceleration and discharge it from the machine. The restriction of water flow from the basket to the tub and the pumping means cooperate to lower the level of water between the tub and basket as compared to the level of water in the basket. As a result, the frictional drag on the basket is reduced relative to that in the prior art machine described above thus allowing the basket to more rapidly accelerate and pass through the critical rotational speed more quickly.

If there is less than 20 percent of the initial water in the machine as measured under water only load conditions when 220 revolutions per minute is reached, the unbalance capacity improvement is not satisfactorily achieved and if there is more than 40 percent, the water extraction and power consumption are detrimentally affected without any significant unbalance capacity improvement.

With reference to FIG. 2, the clothes washing machine 1 is shown in its condition near the beginning of its acceleration and before the basket reaches the critical rotational speed. Essentially the level of water within the basket 2 is the same as the level between the basket 2 and the tub 4. Due to the centrifugal force induced by the rotating mass of the basket, water and clothes, the body of water in the basket assumes a parabolic configuration as viewed in vertical cross section. The water between the tub and basket also is caused to have a parabolic configuration because of the forces generated by the rotating basket. In comparing the level of water in the basket relative to the level of water between the basket and tub it should be considered at the upper point, designated "P" and $P_1$" on the parabolas where the water contacts the wall of the basket and tub, respectively. An unbalance weight, designated "W," is shown as immersed in the wash water within the basket. There would be at this time substantial frictional drag on the exterior surface 58 of the basket 2 because of the relatively high level of water surrounding the outside of the basket 2.

FIG. 3 shows the condition of the clothes washer machine as it is passing through the critical rotational speed. The critical speed of rotation will vary somewhat from one machine to another depending upon all the factors that contribute to the total system. In the preferred embodiment clothes washing machine the range is between 130 and 220 revolutions per minute. It will be noted that the unbalance weight "W" is immersed or substantially immersed in the water. Also, the level of water $P_1$ between the basket and tub is substantially lower than the water level P in the basket thus reducing the friction on the basket to allow more rapid acceleration of the basket through the critical speed of rotation.

Figure 4:
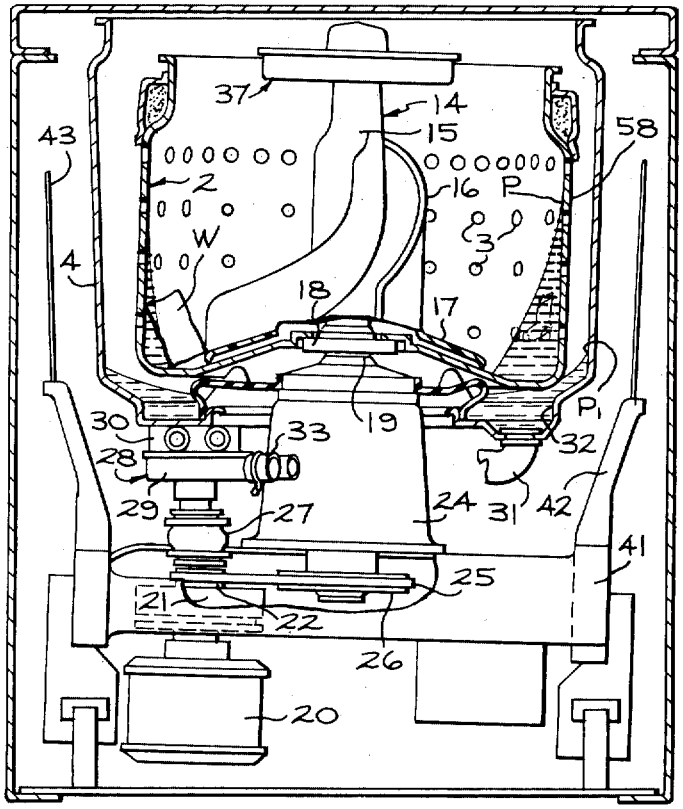
FIG. 4 is a schematic front elevational view of a clothes washing machine incorporating my invention similar to FIG. 1 showing the machine in its post critical speed condition.

FIG. 4 shows the condition of the clothes washer machine 1 after it has passed through the critical rotational speed and is accelerating in speed toward maximum speed of rotation of approximately 600 revolutions per minute. In this condition there is an amount of water opposite the unbalance load thus effecting sufficient counterbalancing within the basket to reduce the amplitude of vibration. This phenomenon commonly referred to as phase angle shift, in post critical speed acceleration is well known in the art.

When the basket speed of rotation approaches the maximum speed of rotation of 600 revolutions per minute most all of the water will have passed through the perforations 3 into the tub and particularly the uppermost circular row of perforations 3 due to the centrifugal force exerted on the water forcing it out through the perforations.

Figure 5:
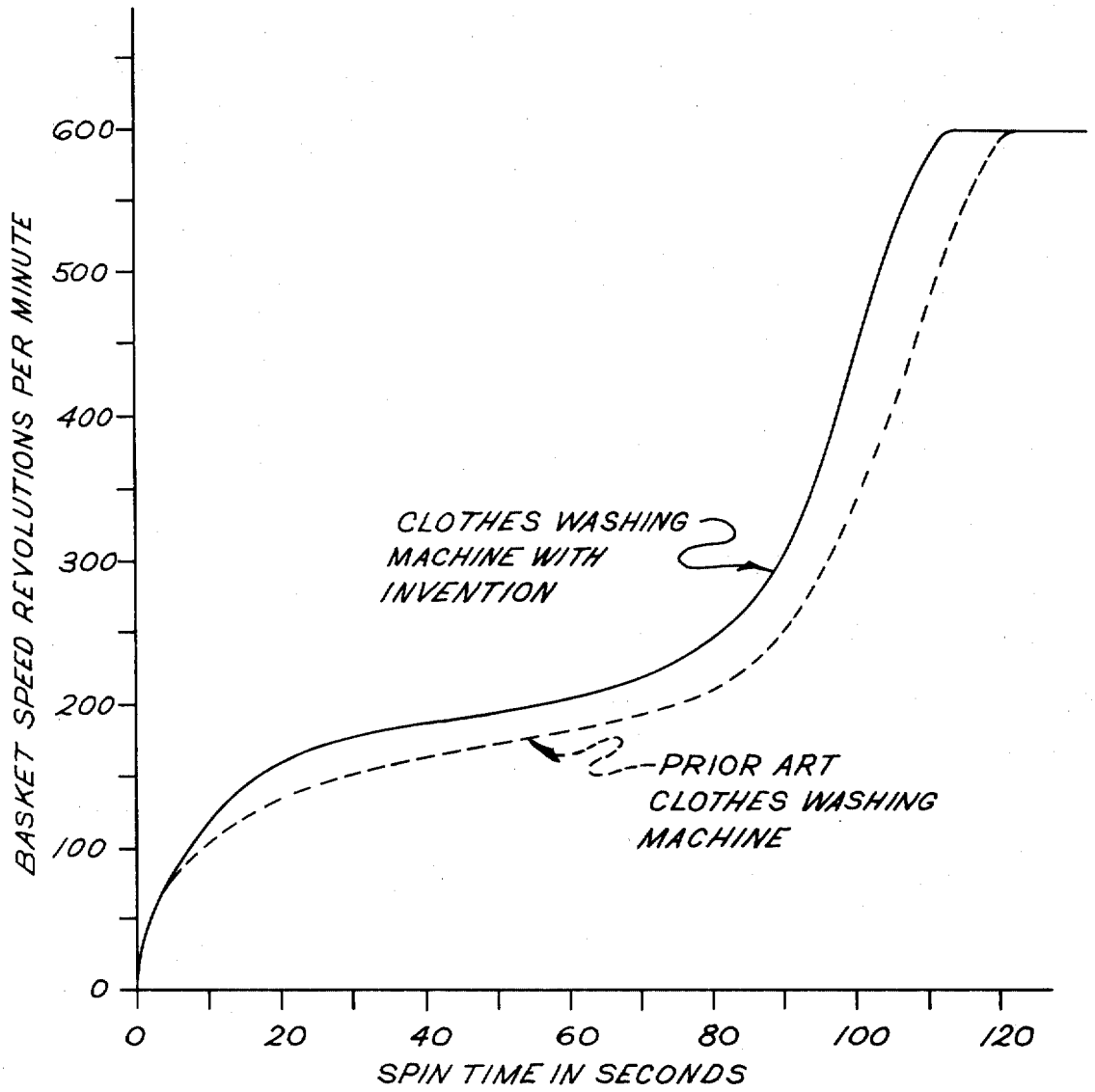
FIG. 5 is a graph showing test runs of a prior art clothes washing machine and a clothes washing machine utilizing the present invention.

With reference to FIG. 5 there are two curves plotted resulting from ten separate test runs comparing the time versus speed of rotation of the basket of both a prior art clothes washing machine (dotted line) and a clothes washing machine utilizing the present invention (solid line). All of the test runs were conducted under water only load conditions, that is, there were no clothes being washed and the level of water was the same for every test run with the amount of water being 207 lbs. at the beginning of each test run. In the case of the prior art clothes washer machine there was 27 pounds of water in the machine when the basket was being accelerated at 220 revolutions per minute. This represents 13% of the initial amount of water in the machine. In the machine utilizing the present invention there was 62 pounds of water in the machine when the basket was being accelerated at 220 revolutions per minute. This represents 30% of the initial water in the machine. It will be noted from the respective curves that the basket acceleration through the upper level of the range of critical rotational speed, namely 220 revolutions per minute, was approximately 15 seconds faster.

Figure 6:
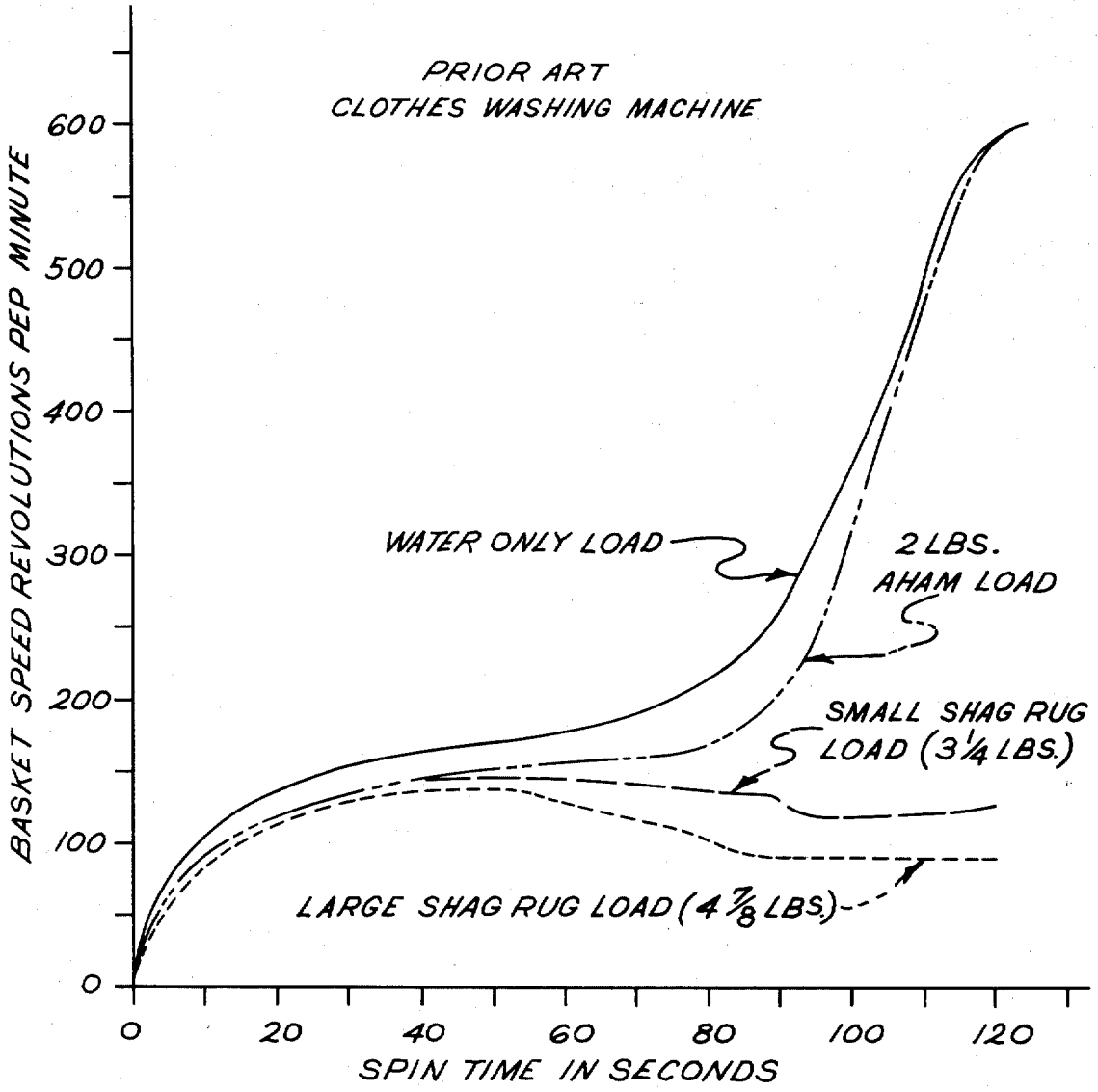
FIG. 6 is a graph showing test runs of a prior art clothes washing machine with different type loads.

FIG. 6 shows the results of a number of test runs that were conducted using a prior art clothes washing machine with curves plotted in connection with various small clothes washing loads in which the time is plotted against the basket speed of rotation. It will be noted that in tests conducted on both a small and large shag rug that the basket rotational speed never did pass through its critical rotational speed. The AHAM two pound load is a standard industry two pound load established by the Association of Home Appliance Manufacturers and is published in "Household Washer Performance Evaluation Procedure" Standard HLW-1 dated January, 1970.

Figure 7:
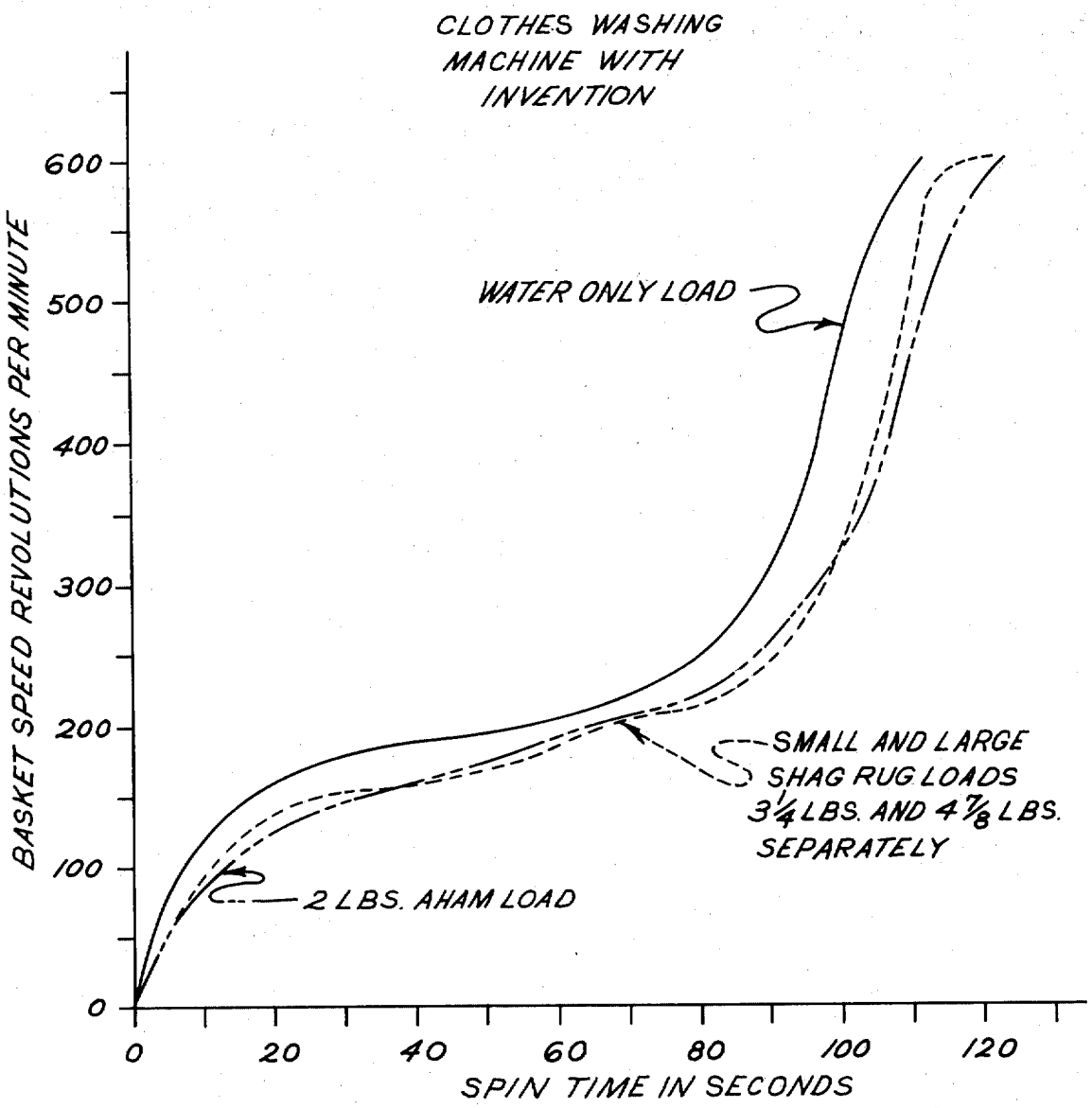
FIG. 7 is a graph showing test runs of a clothes washing machine utilizing the present invention with the same load conditions plotted in FIG. 6.

FIG. 7 shows a group of tests similar to that of FIG. 6, however, a clothes washing machine utilizing the present invention was tested. It will be noted that in this case the machine did not fail in passing through critical for the small and the large shag rugs and that the tests for each followed the same curve.

The foregoing is a description of the preferred embodiment of the invention and variations may be made thereto without departing from the true spirit of the invention, as defined by the appended claims.

What is claimed is:

1. In a clothes washing machine having a centrifugal water extraction operation and including a tub for containing water, a clothes receiving basket in the tub, said basket having perforations arranged in a pattern from the top to the bottom of the side wall thereof, a pump for removing water from the tub, means for rotatively accelerating the basket from zero to over 220 revolutions per minute, the improvement comprising:

means to retain between 20 and 40% of the initial water in the machine as measured under water only load conditions until 220 revolutions per minute is reached, means to pump water continuously from between the tub and basket during basket acceleration from zero to 220 revolutions per minute and discharge it from the machine, and means to restrict the flow of water from the basket to the tub such that the level of water between the tub and basket is lower than the level of water in the basket.

2. In a clothes washing machine of claim 1 wherein the means for rotatively accelerating the basket from zero to over 220 revolutions per minute includes means for doing so within 60 to 80 seconds as timed under water only load conditions.

3. In the clothes washing machine of claim 1 wherein the means to restrict the flow of water from the basket to the tub is the perforation pattern and size of the perforations in the side wall of the basket.

4. In the clothes washing machine of claim 1 wherein the side wall of the basket where the perforations are located is straight sided.

5. In the clothes washing machine of claim 1 wherein the perforations are between 4 and 6 horizontal circular rows.

6. The method of improving unbalance capacity in a clothes washing machine during the centrifugal water extraction operation, said clothes washer including a tub, a clothes receiving basket in the tub, said basket having perforations arranged in a pattern from the top to the bottom of the side wall, a pump for removing water from the tub, the improvement comprising:

accelerating the basket from zero to over 220 revolutions per minute;

retaining between 20 and 40% of the initial water in the machine as measured under water only load conditions until 220 revolutions per minute is reached, and pumping water continuously from between the basket and tub during basket acceleration from zero to 220 revolutions per minute and discharging it from the machine, and restricting the flow of water from the basket to the tub such that the level of water between the tub and basket is lower than the level of water in the basket.

7. The method of improving unbalance capacity in a clothes washing machine of claim 6 wherein accelerating the basket from zero to over 220 revolutions per minute is within 60 to 80 seconds as timed under water only load conditions.

* * * * *